US006530129B1

(12) United States Patent
Cheng

(10) Patent No.: US 6,530,129 B1
(45) Date of Patent: Mar. 11, 2003

(54) GOLF BAG CARRYING STRUCTURE

(76) Inventor: Ching-Feng Cheng, No. 208, Ta An Kang Rd., Ta-Chia Township, Taichung Hsien (TW)

( * ) Notice: Subject to any disclaimer, the term of this patent is extended or adjusted under 35 U.S.C. 154(b) by 0 days.

(21) Appl. No.: 10/052,663

(22) Filed: Jan. 23, 2002

(51) Int. Cl.[7] ..... A44B 11/00; A45F 3/04; A63B 55/00

(52) U.S. Cl. ..... 24/200; 24/196; 24/197; 224/627; 224/645; 224/264; 206/315.5

(58) Field of Search ..... 24/200, 196, 197; 224/627, 645, 264; 206/315.5

(56) References Cited

U.S. PATENT DOCUMENTS 2,820,498 A * 1/1958 Endee ..... 224/645
5,361,953 A * 11/1994 Nichols ..... 224/645
5,558,259 A * 9/1996 Izzo ..... 224/627
6,152,342 A * 11/2000 Suk ..... 224/645
6,283,350 B1 * 9/2001 Gottmeier et al. ..... 224/627
6,460,747 B1 * 10/2002 Tuerschmann et al. ..... 224/645

* cited by examiner

*Primary Examiner*—Victor Sakran
(74) *Attorney, Agent, or Firm*—Harrison & Egbert

(57) ABSTRACT

A structure is designed to carry a golf bag on the back of a caddie. The structure includes a first shoulder strap, a second shoulder strap, a ratchet buckle, an upper buckle, and a lower buckle. The first shoulder strap and the second shoulder strap are superimposed in the ratchet buckle such that one end of the first shoulder strap is held by the upper buckle which is fastened to the golf bag, and such that one end of the second shoulder strap is held by the lower buckle which is fastened to the golf bag.

4 Claims, 16 Drawing Sheets

GOLF BAG CARRYING STRUCTURE

BACKGROUND OF THE INVENTION

1. Field of the Invention

The present invention relates generally to a golf bag, and more particularly to a structure for carrying the golf bag on the back of a caddie.

2. Description of Related Art

As shown in FIGS. 1–3, a conventional golf bag 1 is provided with two shoulder straps 2 and 3, which are fastened by a buckle 4 such that the two shoulder straps 2 and 3 are cruciformly held in place. The two shoulder straps 2 and 3 are fastened to the golf bag 1 by two metal rings 7 and 8, which are respectively held by a fabric piece 5 or 6 attached to the golf bag 1 by sewing.

The buckle 4 referred to above is disclosed in the U.S. Pat. No. 6,152,342. As shown in FIGS. 2 and 3, the buckle 4 has two arcuate through slots 401 and 402, which are located at two longitudinal ends of the buckle 4. Located between the two arcuate through slots 401 and 402 are two long holes 403 and 404. The buckle 4 is capable of holding the two shoulder straps 2 and 3 in a cruciform manner. In view of the fact that the arcuate through slots 401 and 402, and the two long holes 403 and 404 of the buckle 4 are provided with a smooth inner wall which is incapable of catching securely the shoulder straps 2 and 3, the buckle 4 is apt to slide along the shoulder straps 2 and 3, thereby resulting in an imprecise demarcation of the two shoulder straps 2 and 3. In addition, most of the outer surface of the buckle 4 is covered by the shoulder straps 2 and 3 such that the brand name, trademark, or name of maker of buckle printed thereon is often obstructed by the shoulder straps 2 and 3.

The two shoulder straps 2 and 3 are jointly fastened at one end with the golf bag 1 by means of a metal ring 7(8). As a result, the ends of the shoulder straps 2 and 3 are apt to twist together at the time when the golf bag I is carried on the back of a caddie.

BRIEF SUMMARY OF THE INVENTION

The primary objective of the present invention is to provide a golf bag—with buckling members for fastening securely two shoulder straps of the golf bag in such a manner that the two shoulder straps are neatly arranged, and that the two shoulder straps do not intertwist at the time when the golf bag is carried on the back of a caddie.

The features and the advantages of the present invention will be more readily understood upon a thoughtful deliberation of the following detailed description of the present invention with reference to the accompanying drawings.

DETAILED DESCRIPTION OF THE INVENTION

Figure 1:
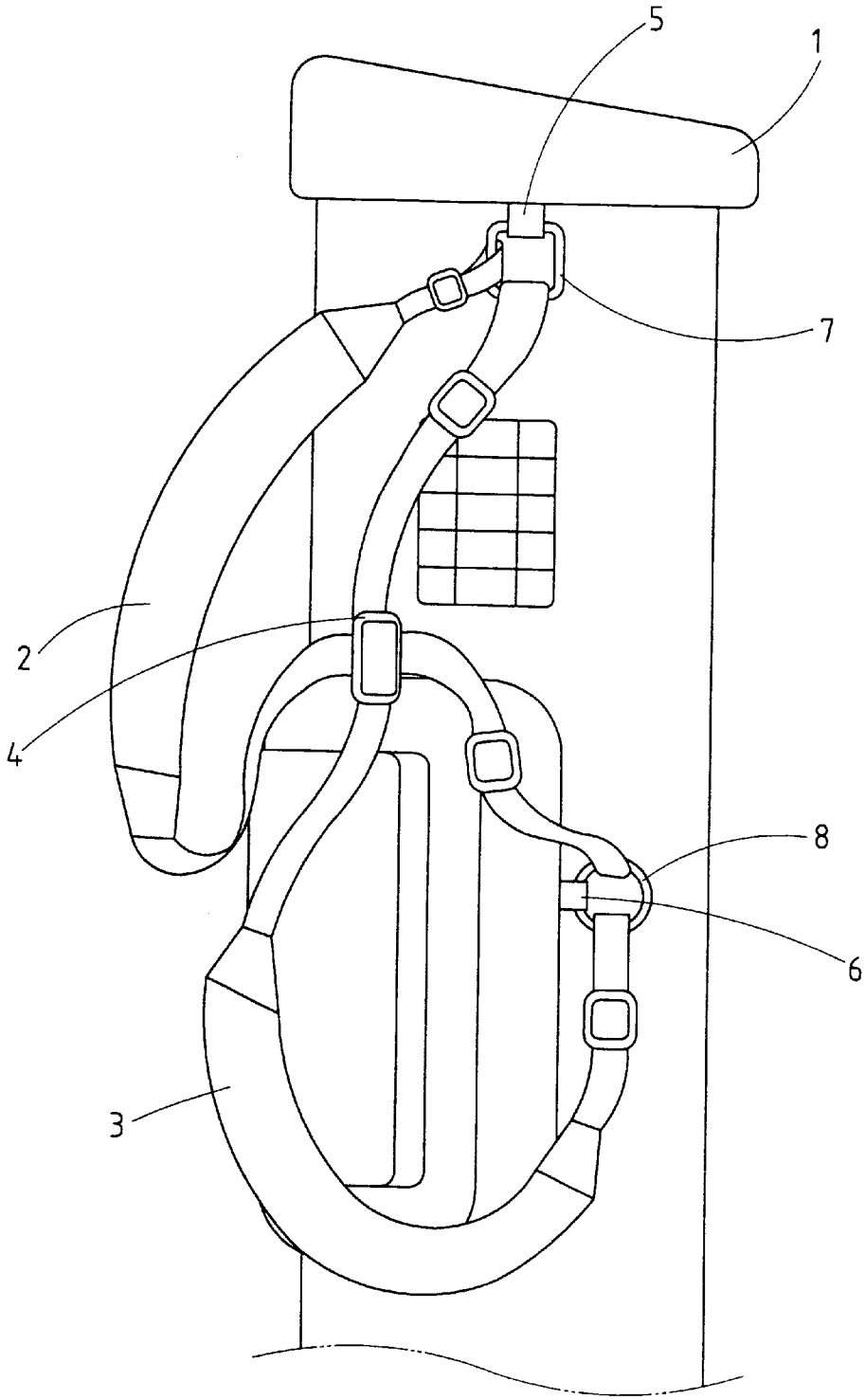
FIG.1 PRIOR ART
FIG. 1 shows a schematic view of a prior art golf bag with shoulder straps and buckle attached thereto.
Figure 2:
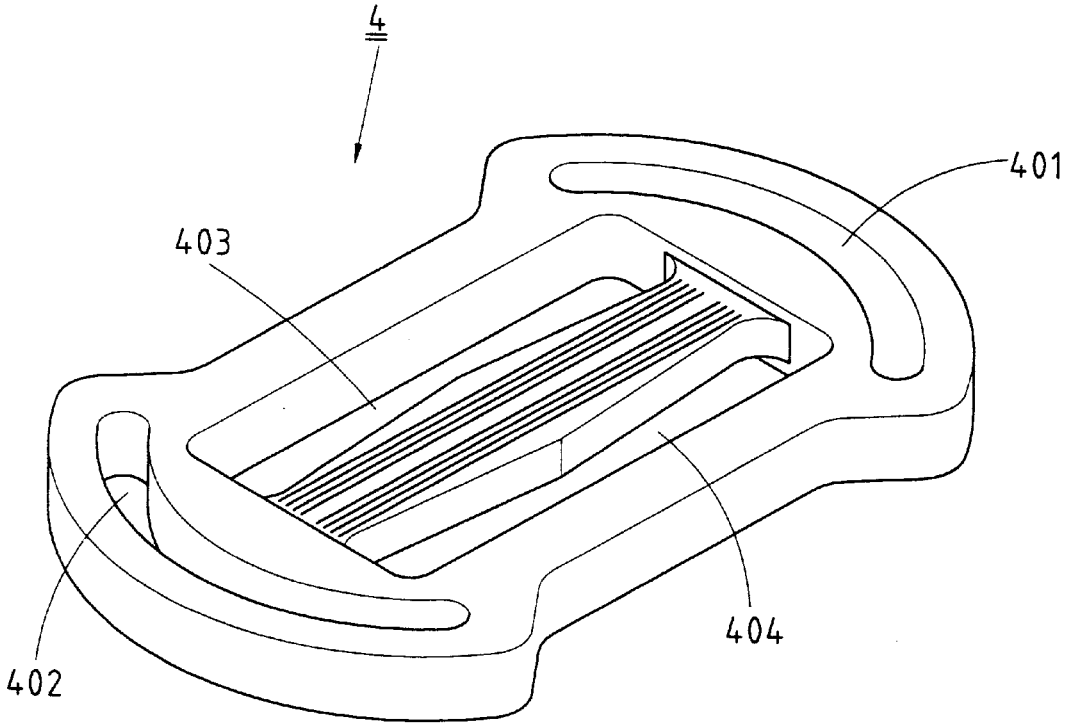
FIG.2 PRIOR ART
FIG. 2 shows a perspective view of a prior art buckle as sh in FIG. 1.
Figure 3:
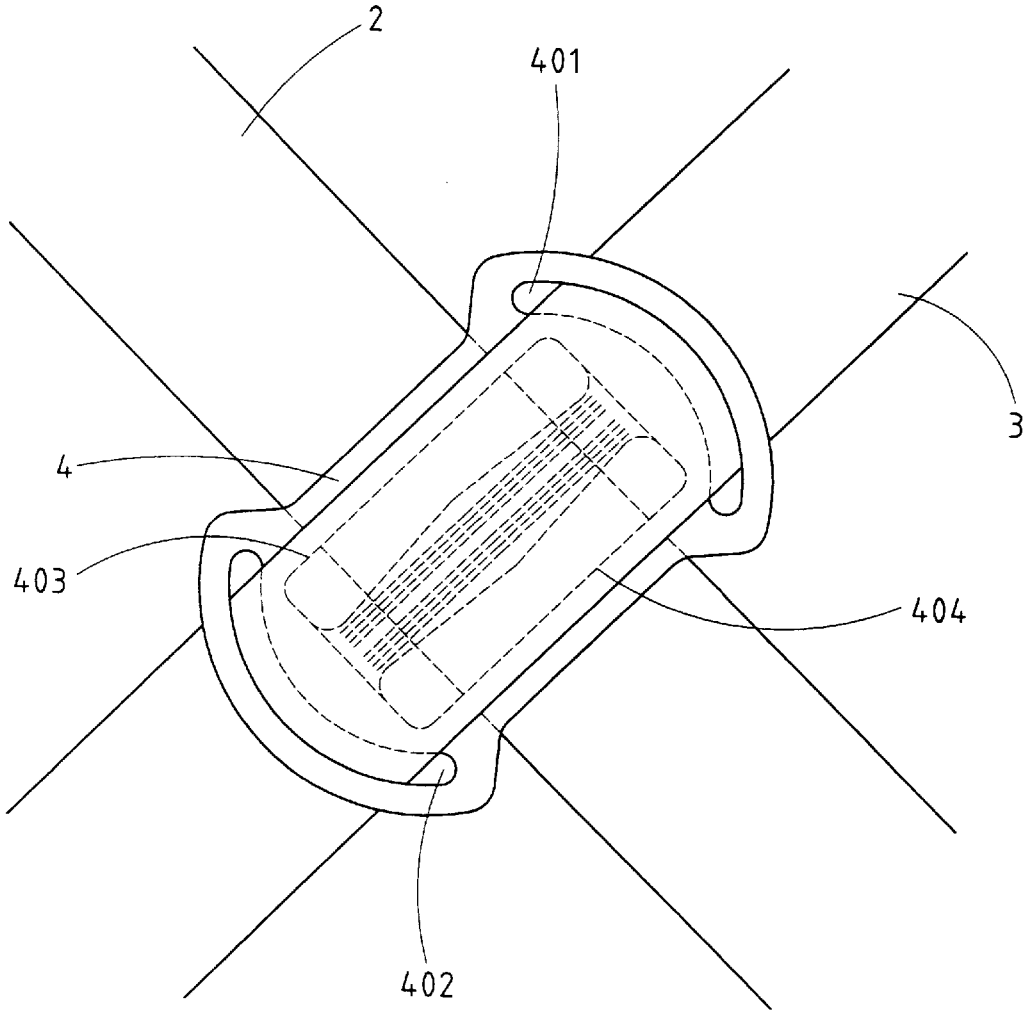
FIG.3 PRIOR ART
FIG. 3 shows a schematic plan view of the prior art buckle of FIG. 2 at work.

As shown in FIGS. 4–9, the buckling members of the present invention are used to fasten in place two shoulder straps 50 and 51 of a golf bag 20 and include a ratchet buckle 10, an upper buckle 60, and a lower buckle 70.

The ratchet buckle 10 has four sides, each being provided with an elongated through slot 101 which is provided with a serrated inner wall 102. The ratchet buckle 10 is provided in the underside with a recess 103, and in the upperside with a flat surface 104. The two shoulder straps 50 and 51 are put through the elongated through slots 101 of the ratchet buckle 10 such that the second shoulder strap 51 is superimposed by the first shoulder strap 50.

Figure 4:
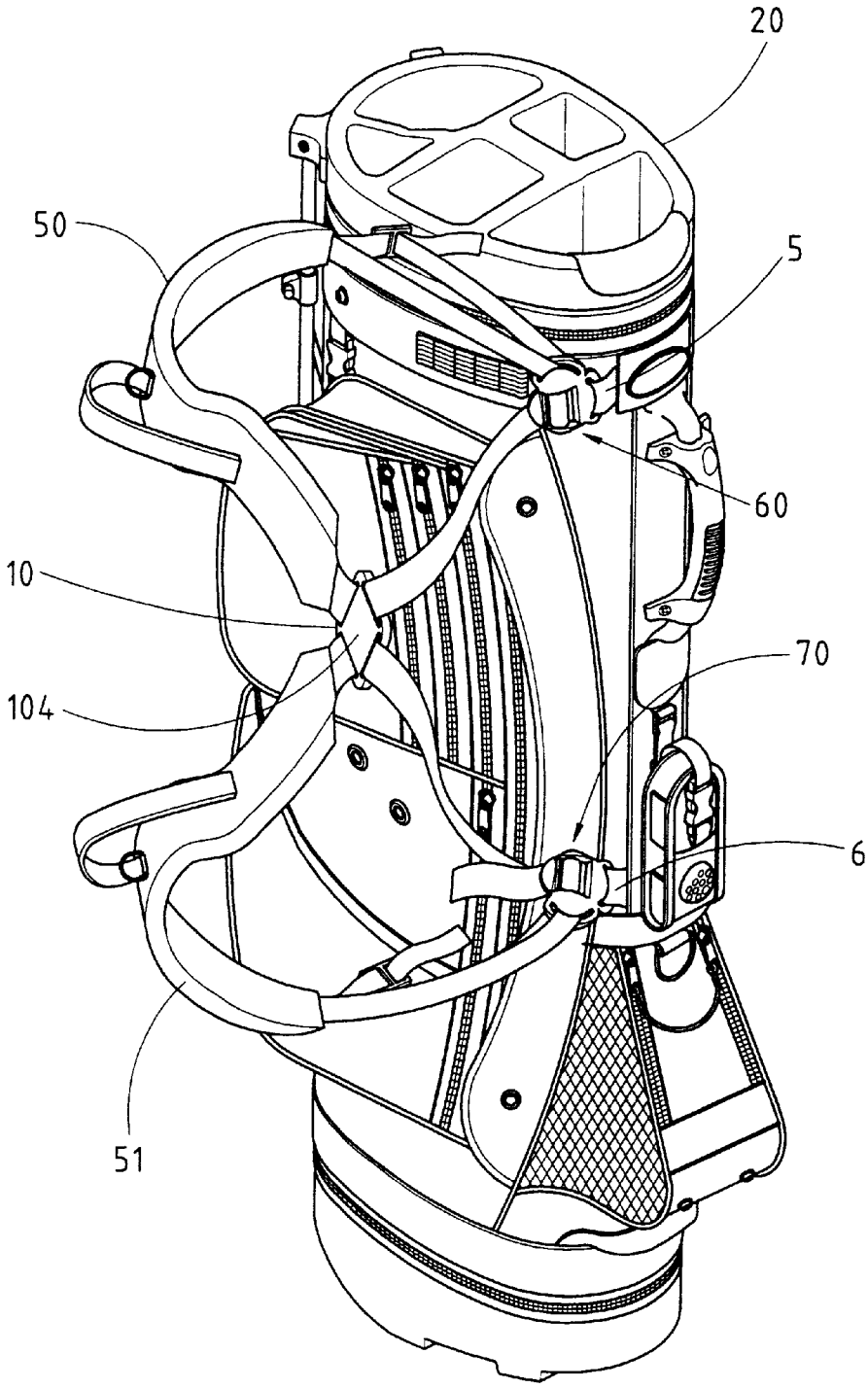
FIG. 4 shows a perspective view of a golf bag of the present invention.
Figure 5:
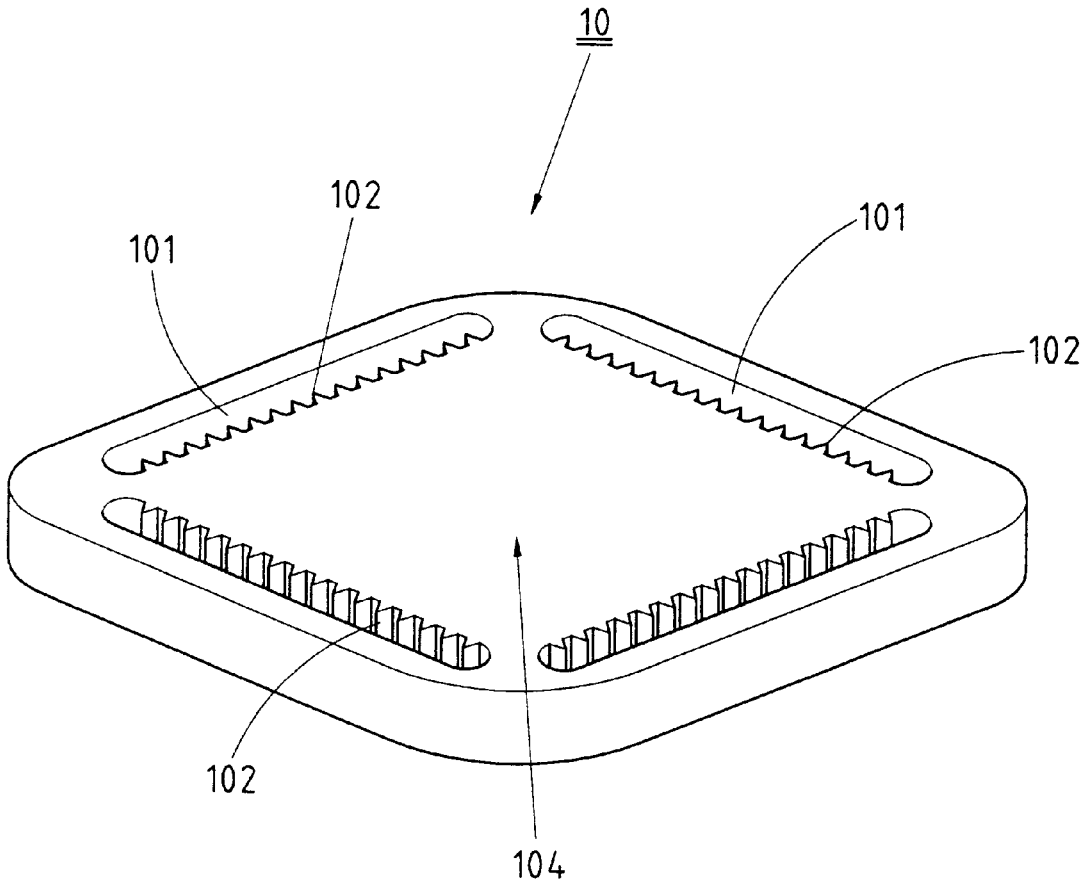
FIG. 5 shows a perspective view of a ratchet buckle of the present invention.
Figure 6:
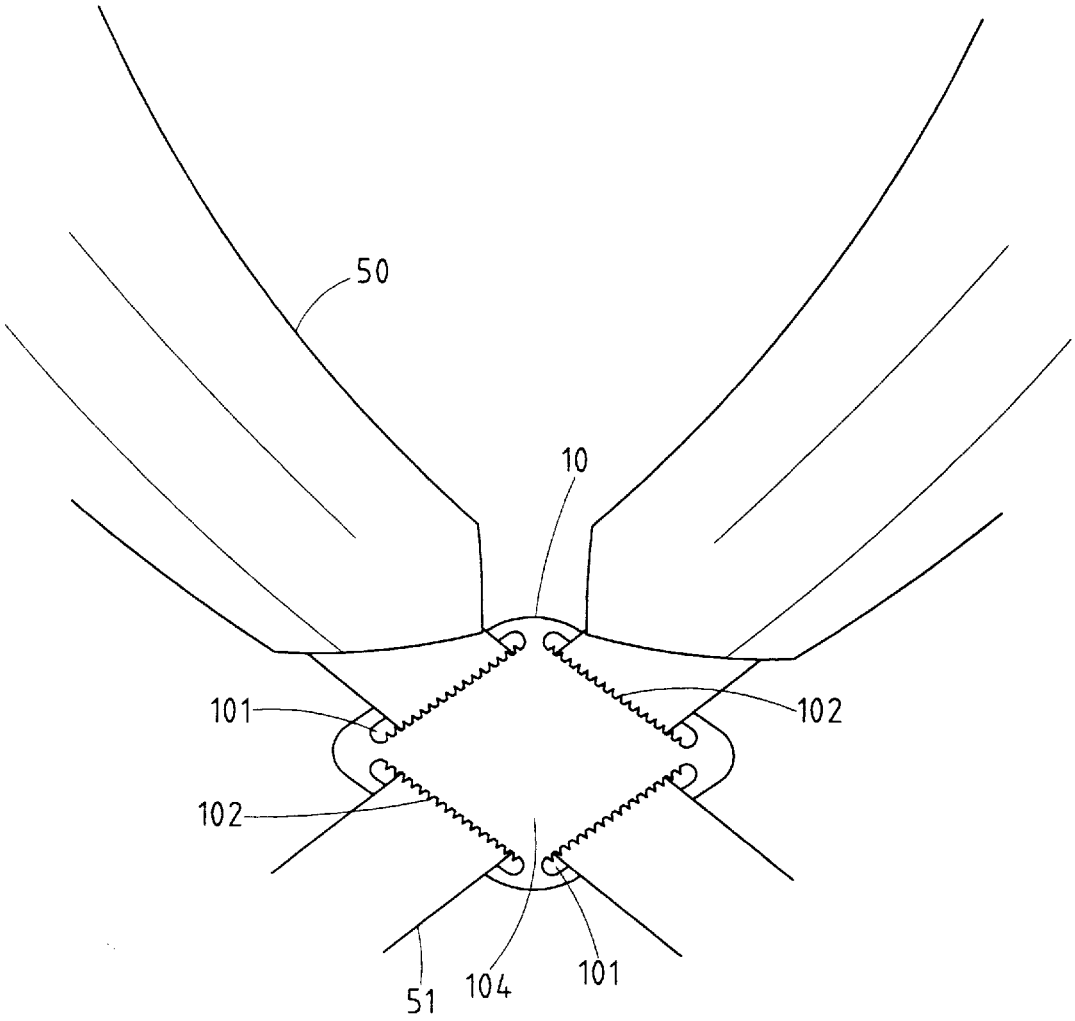
FIG. 6 shows a schematic plan view of the ratchet buckle of the present invention at work.
Figure 7:
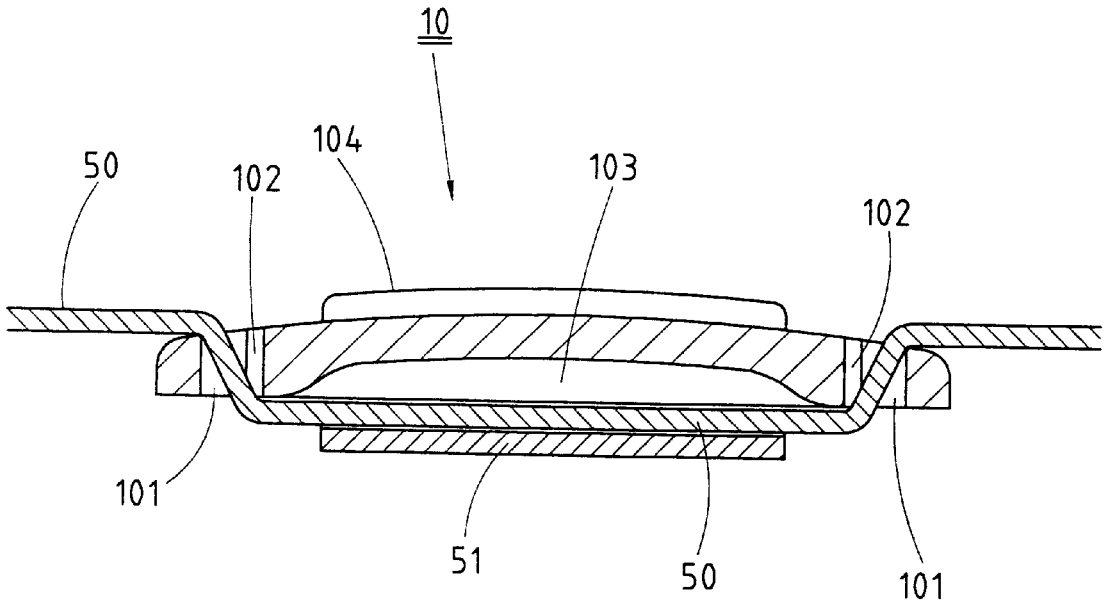
FIG. 7 shows a sectional view of the ratchet buckle of the present invention at work.
Figure 8:
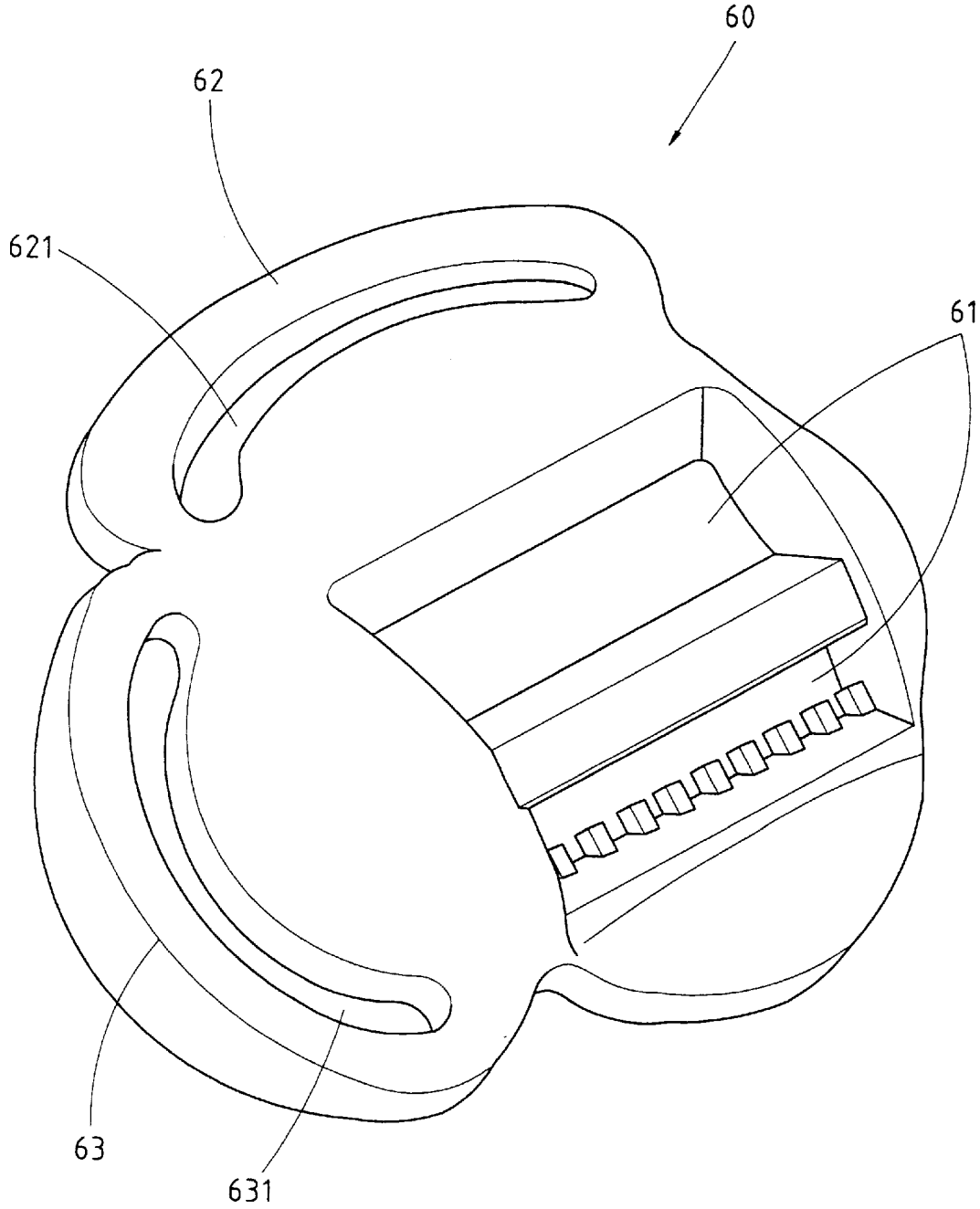
FIG. 8 shows a perspective view of an upper buckle of the present invention.
Figure 9:
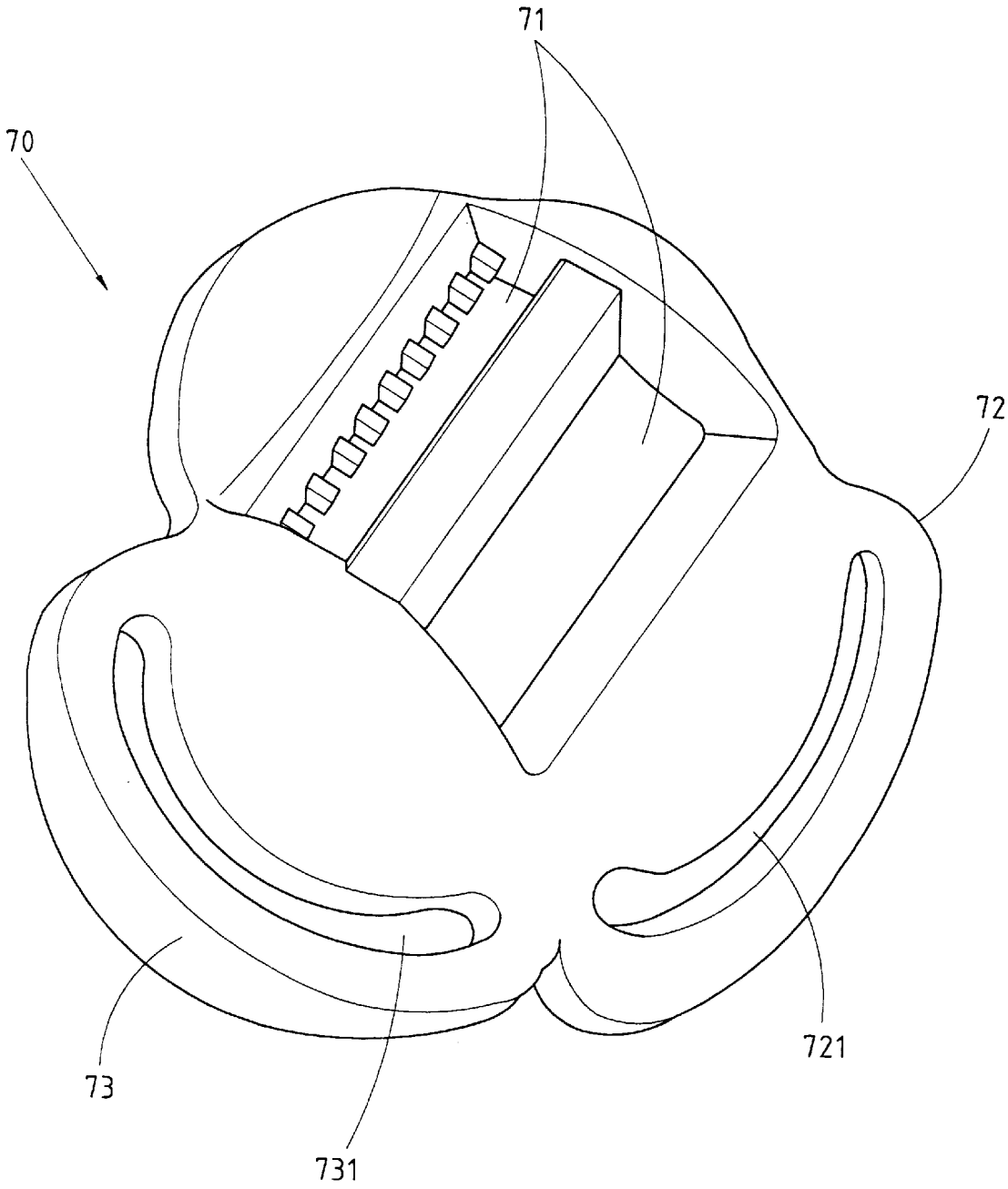
FIG. 9 shows a perspective view of a lower buckle of the present invention.

As shown in FIGS. 4, 8, and 9, the upper buckle 60 is provided in the center with two long holes 61 which are separated from each other and are opposite to each other, The upper buckle 60 is further provided with two protrusions 62 and 63 contiguous to each other. The first protrusion 62 is provided with an arcuate hole 621, while the second protrusion 63 is provided with an arcuate hole 631. The upper buckle 60 is fastened to the golf bag 20 by a fabric piece 5 which is put through the first arcuate hole 621 of the first protrusion 62. One end of the first shoulder strap 50 is put through the second arcuate hole 631 of the second protrusion 63.

The lower buckle 70 is provided in the center with two long holes 71 which are separated from each other and are opposite to each other. The lower buckle 70 is further provided with two protrusions 72 and 73 contiguous to each other. The first protrusion 72 is provided with a first arcuate hole 721, whereas the second protrusion 73 is provided with a second arcuate hole 731. The lower buckle 70 is fastened to the golf bag 20 by a fabric piece 6 which is put through the first arcuate hole 721 of the first protrusion 72. One end of the second shoulder strap 51 is put through 20 the second arcuate hole 731 of the second protrusion 73.

As shown in FIGS. 10–14, the buckling members of the present invention further include an independent buckle 65, a hook 66, and a male retainer 67. The independent buckle 65 is provided with two long through holes 651 and a protuberance 652 which is in turn provided with an arcuate through hole 653. The first shoulder strap 50 has a tail end 501, which is put through the two long through holes 651 of the independent buckle 65, and an annular body 671 of the male retainer 67 before being wound back to put through the two long through holes 651, thereby enabling the tail end 501 of the first shoulder strap 50 to join with the male retainer 67 by means of the independent buckle 65. The first shoulder strap 50 is provided in the midsegment with a tape 502 for retaining a retaining piece 68. The second shoulder strap 51 has a tail end 511 which is put through a retaining piece 69, an annular body 661 of the hook 66, and the retaining piece 69 again. The tail end 511 of the second shoulder strap 51 is joined with the hook 66 by means of the retaining piece 69. The second shoulder strap 51 is provided in the midsegment with a tape 512, which is put through a retaining piece 70. The second shoulder strap 51 has a head end 513, which is joined with the retaining piece 70 via the arcuate through hole 653 of the independent buckle 65. The hook 66 and the male retainer 67 of the two shoulder straps 50 and 51 are engageable with a ring 72 and a female retainer 71 of a golf bag 30 respectively. The first shoulder strap 50 has a head end 503, which is joined with the retaining piece 68 of the tape 502 via the ring 72 of the golf bag 30.

Figure 10:
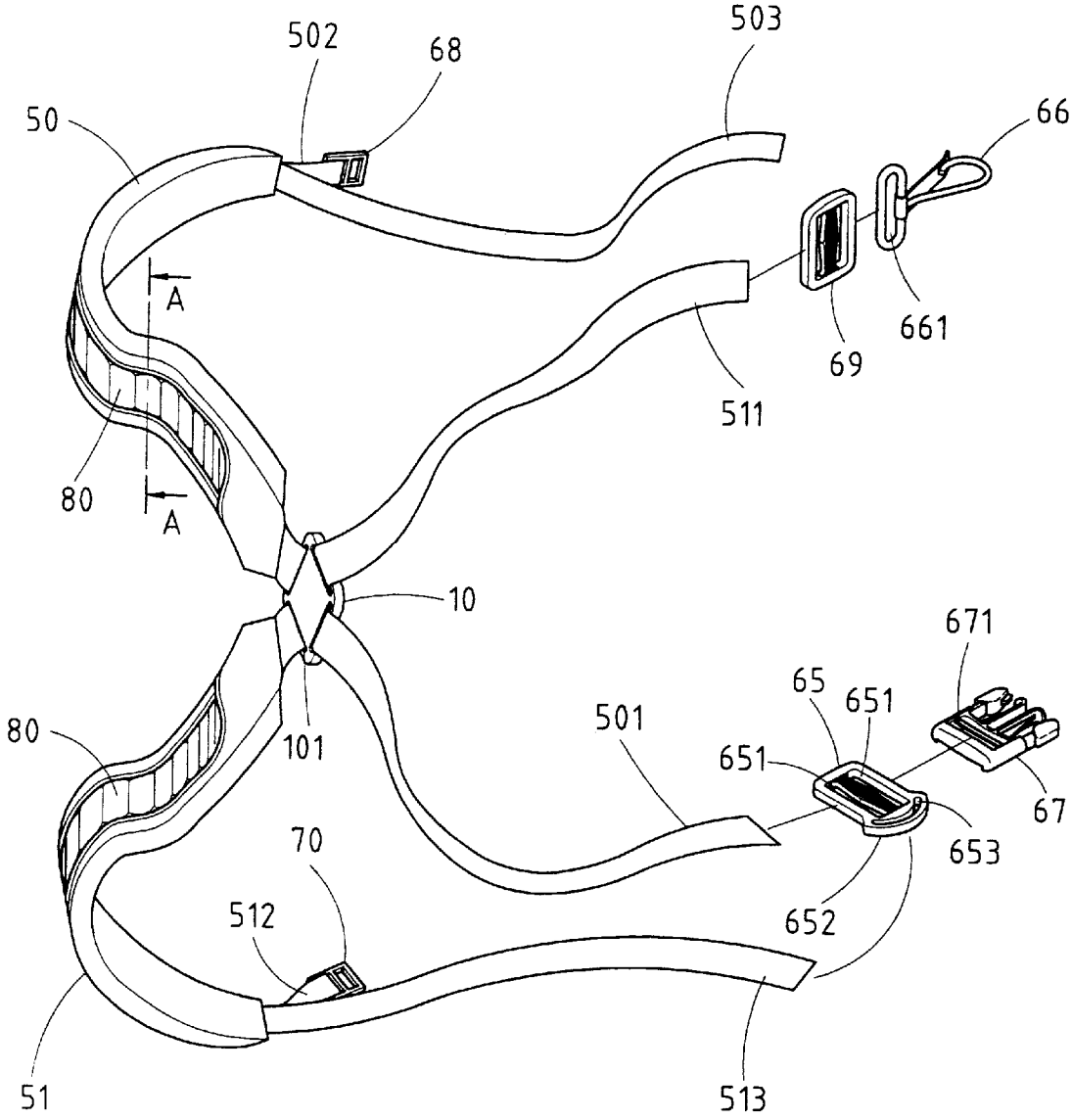
FIG. 10 shows a perspective view of two shoulder straps of another preferred embodiment of the present invention.
Figure 11:
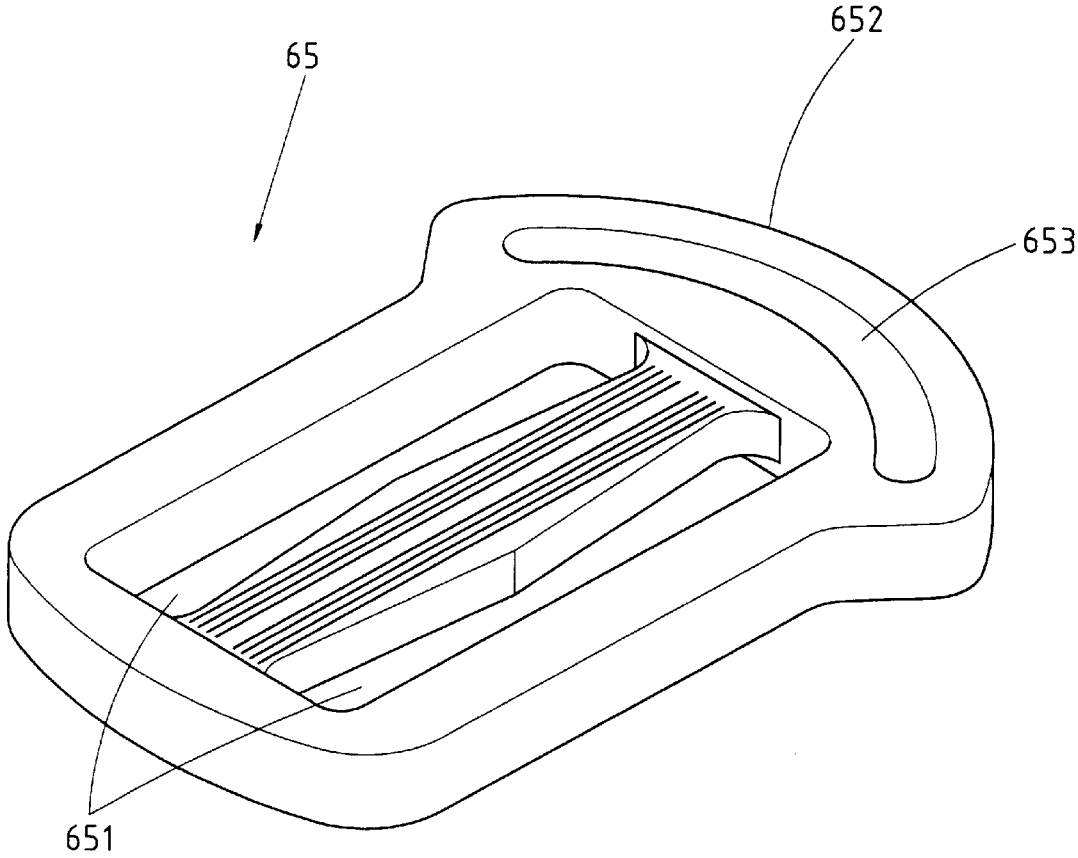
FIG. 11 shows a perspective view of an independent buckle of the present invention.
Figure 12:
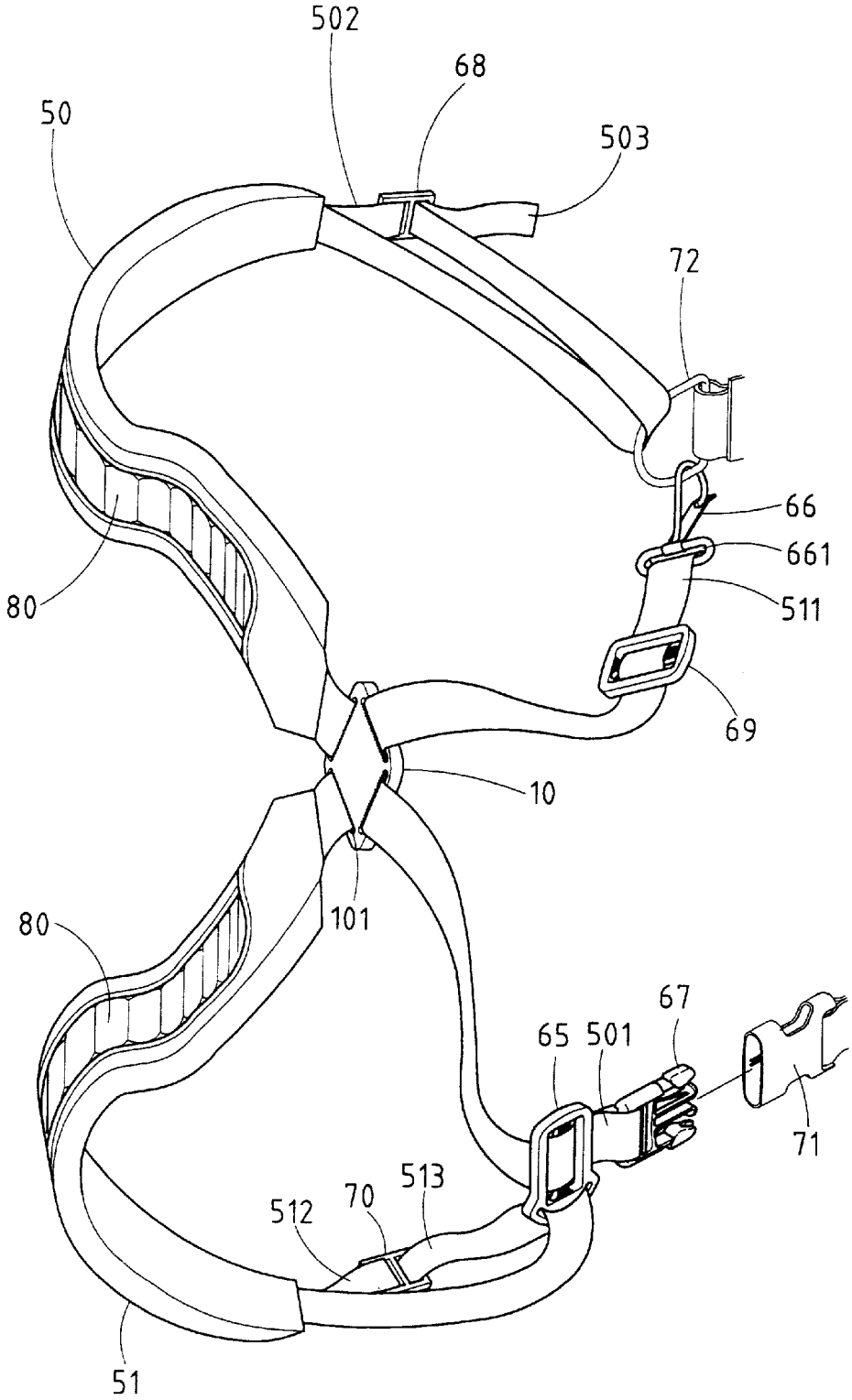
FIG. 12 shows a perspective view of the two shoulder straps of FIG. 10.
Figure 13:
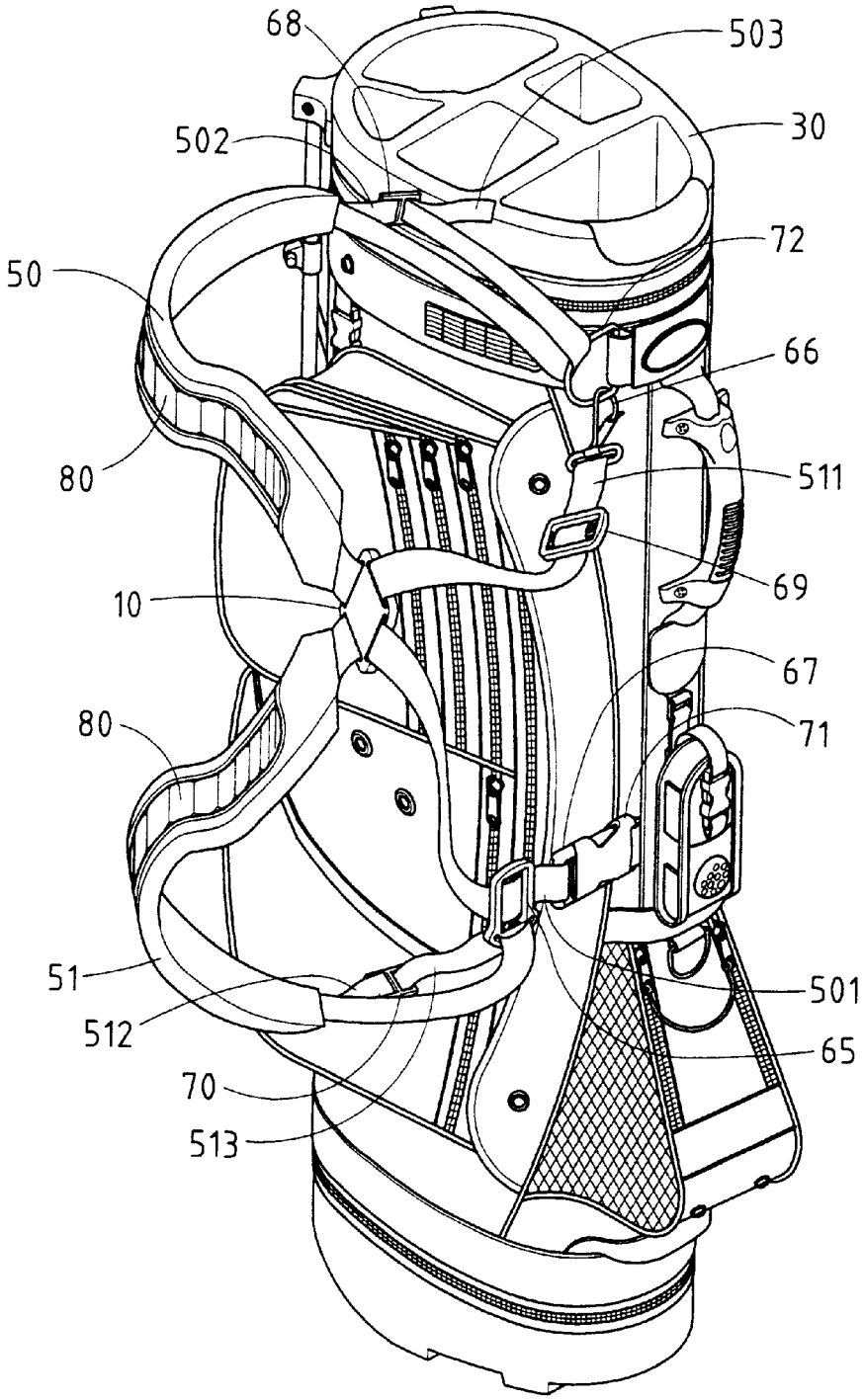
FIG. 13 shows a perspective view of a golf bag which is provided with the shoulder straps as shown in FIGS. 10 and 12.
Figure 14:
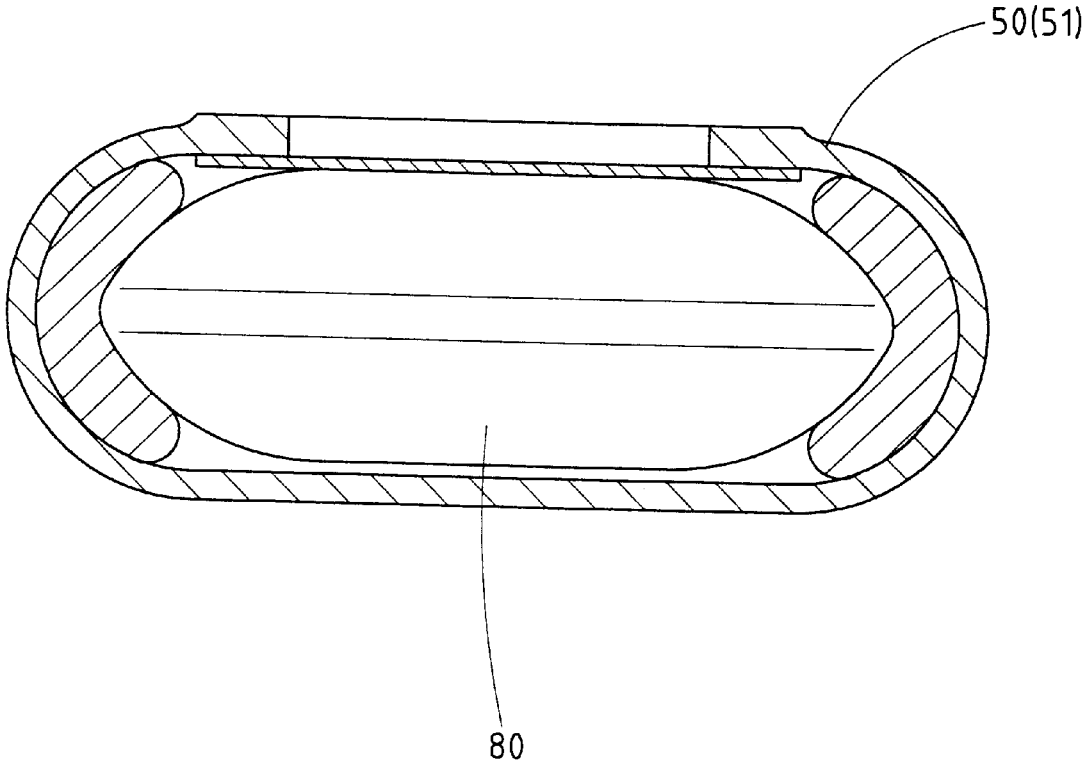
FIG. 14 shows a sectional view of a portion taken along the direction as indicated by a line A—A as shown in FIG. 10.

As shown in FIGS. 10 and 14, the two shoulder straps 50 and 51 provided with an air sac 80.

Figure 15:
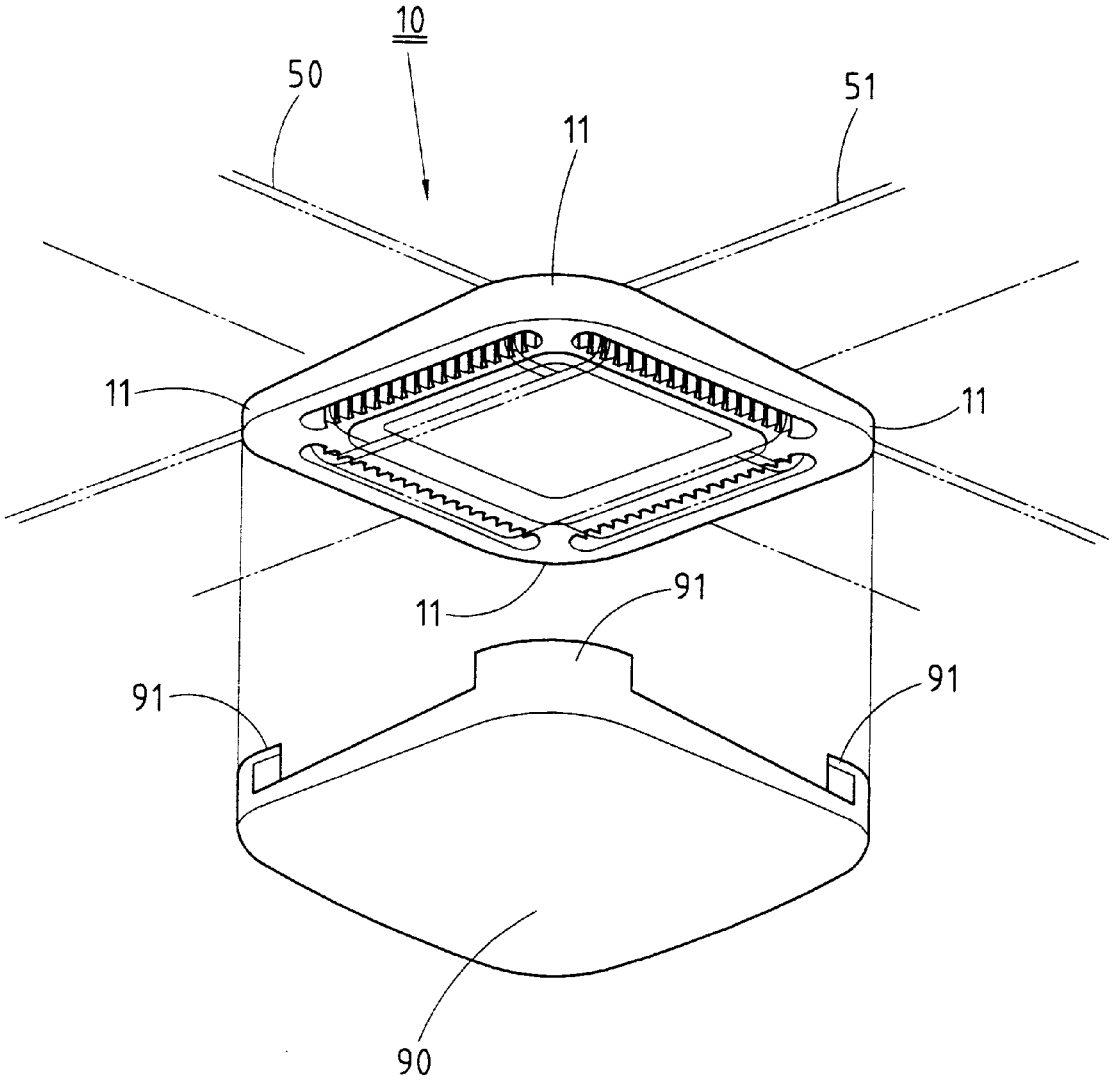
FIG. 15 shows an exploded view of a ratchet buckle of another preferred embodiment of the present invention.
Figure 16:
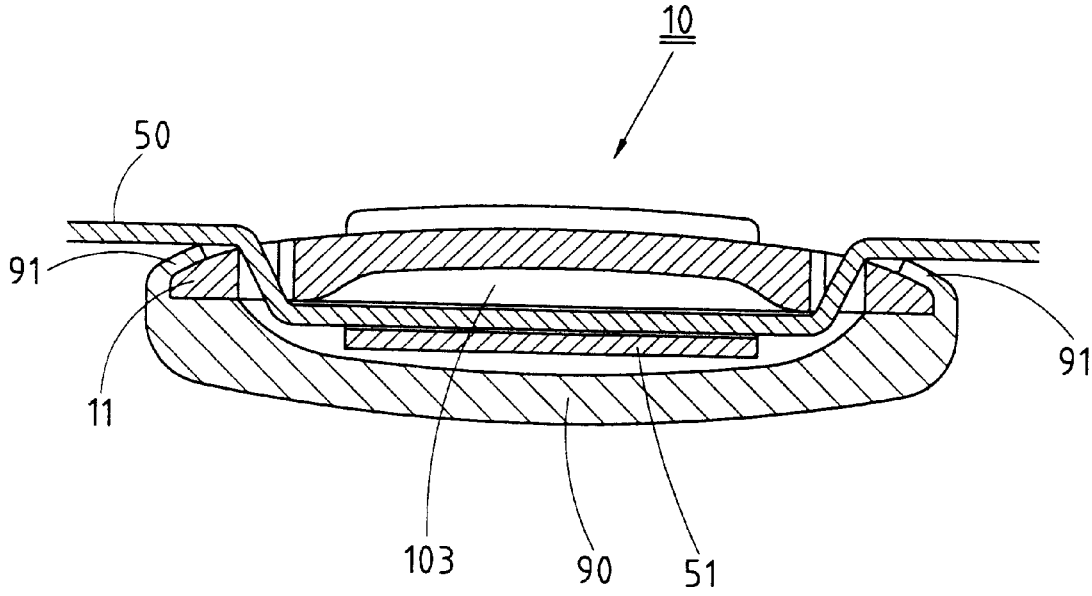
FIG. 16 shows a sectional view of the ratchet buckle of FIG. 15 in combination.

As shown in FIGS. 15 and 16, the ratchet buckle 10 is provided in the underside with a soft pad 90 which is provided with a plurality of inverted hooks 91. The ratchet buckle I0 is provided with a plurality of retaining corners 11. The soft pad 90 is joined with the ratchet buckle 10 such that the hooks 91 of the soft pad 90 catch the retaining corners 11 of the ratchet buckle 10. The pad 90 serves as a cushion to provide comfort to the back of a caddie. Similarly, the air sacs 80 of the shoulder straps 50 and 51 are intended to provide comfort to the shoulders of the caddie.

As shown in FIGS. 10–13, the shoulder straps 50 and 51 of the preferred embodiment of the present invention can be sold as a unit independent of the golf bag 30.

The present invention described, above is to be regarded in all respects as being merely illustrative. Accordingly, the present invention may be embodied in other specific forms without deviating from the spirit thereof. The present invention is therefore to be limited only by the scope of the following claims.

I claim:

1. A structure for carrying a golf bag on the back of a caddie comprising:

a first shoulder strap;

a second shoulder strap;

a ratchet buckle having four sides, each having a through slot whereby said through slot is comprised of a serrated inner wall for catching said first shoulder strap and said second shoulder strap which are put through said through slots of said ratchet buckle such that said two shoulder straps are superimposed;

an upper buckle comprised of a first protrusion and a second protrusion, said first protrusion being provided with a first arcuate hole, said second protrusion being provided with a second arcuate hole, said upper buckle being fastened to the golf bag by a fastening piece which is put through said first arcuate hole of said first protrusion whereby said upper buckle holds said first shoulder strap such that one end of said first shoulder strap is put through said second arcuate hole of said second protrusion; and a lower buckle comprised of a first protrusion and a second protrusion, said first protrusion being provided with a first arcuate hole, said second protrusion being provided with a second arcuate hole, said lower buckle being fastened to the golf bag by a fastening piece which is put through said first arcuate hole of said first protrusion whereby said lower buckle holds said second shoulder strap such that one end of said second shoulder strap is put through said second arcuate hole of said second protrusion.

2. The structure as defined in claim 1, wherein said one end of said first shoulder strap is comprised of a male retainer fastened thereto in conjunction with an independent buckle such that said male retainer is engaged with a female retainer of the golf bag whereby said first shoulder strap has another end which is retained by a retaining piece via a ring of the golf bag; wherein said one end of said second shoulder strap is provided with a hook fastened thereto in conjunction with a retaining piece such that said hook is retained by the ring of the golf bag whereby said second shoulder strap has another end which is joined with a retaining piece via an arcuate through hole of said independent buckle.

3. The structure as defined in claim 1, wherein said first shoulder strap and said second shoulder strap are comprised of an air sac fastened thereto such, that said air sac is corresponding in location to the shoulders of the caddie.

4. The structure as defined in claim 1, wherein said ratchet buckle is provided in an underside with a pad fastened thereto.

* * * * *